US008057285B2

(12) United States Patent
Lampka et al.

(10) Patent No.: US 8,057,285 B2
(45) Date of Patent: Nov. 15, 2011

(54) COMFORT GRIP FOR AN ORBITAL ABRASIVE HAND TOOL

(75) Inventors: Mark Lampka, East Amherst, NY (US); Matthew Giles, Amherst, NY (US)

(73) Assignee: Dynabrade, Inc., Clarence, NY (US)

( * ) Notice: Subject to any disclaimer, the term of this patent is extended or adjusted under 35 U.S.C. 154(b) by 212 days.

(21) Appl. No.: 11/507,342

(22) Filed: Aug. 21, 2006

(65) Prior Publication Data

US 2008/0045127 A1 Feb. 21, 2008

(51) Int. Cl.
*B24B 55/06* (2006.01)
*B25G 1/10* (2006.01)

(52) U.S. Cl. ..... 451/344; 16/426; 16/430; 451/456

(58) Field of Classification Search ..... 451/354–359, 451/442, 456, 344; 16/110.1, 421, 422, 426, 16/430; 248/118.1
See application file for complete search history.

(56) References Cited

U.S. PATENT DOCUMENTS

| | | | | |
|---|---|---|---|---|
| D256,881 | S | 9/1980 | Hutchins | |
| 4,531,329 | A * | 7/1985 | Huber | 451/456 |
| D324,800 | S | 3/1992 | Butzen et al. | |
| D324,803 | S | 3/1992 | Butzen et al. | |
| 5,135,190 | A * | 8/1992 | Wilson | 248/118.1 |
| D334,126 | S | 3/1993 | Huber et al. | |
| D350,266 | S | 9/1994 | Huber et al. | |
| D353,984 | S | 1/1995 | Izumisawa | |
| D357,163 | S | 4/1995 | Izumisawa | |
| 5,528,834 | A * | 6/1996 | Seber et al. | 30/340 |
| 5,538,040 | A * | 7/1996 | Huber et al. | 137/614.19 |
| D377,892 | S | 2/1997 | Sung | |
| D381,570 | S | 7/1997 | Sung | |
| D386,377 | S | 11/1997 | Sung | |
| 5,772,498 | A * | 6/1998 | Neubert et al. | 451/357 |
| D427,498 | S | 7/2000 | Price et al. | |
| D436,817 | S | 1/2001 | Leu | |
| D438,078 | S | 2/2001 | Leu | |
| D458,102 | S | 6/2002 | Tseng | |
| D464,857 | S | 10/2002 | Morgan | |
| D465,141 | S | 11/2002 | Morgan | |
| D470,278 | S * | 2/2003 | Liang-Ming | D32/15 |
| 6,669,543 | B2 * | 12/2003 | Price et al. | 451/357 |
| 6,699,111 | B2 * | 3/2004 | Legner et al. | 451/344 |
| D494,434 | S | 8/2004 | Sun et al. | |
| D511,953 | S | 11/2005 | Janson | |
| D516,398 | S | 3/2006 | Janson | |
| 2003/0143935 | A1 * | 7/2003 | Huber | 451/357 |
| 2003/0228833 | A1 | 12/2003 | Boyer | |
| 2010/0099341 | A1 * | 4/2010 | Huber et al. | 451/357 |

* cited by examiner

*Primary Examiner* — Timothy V Eley
(74) *Attorney, Agent, or Firm* — Simpson & Simpson, PLLC

(57) ABSTRACT

The present invention is an abrasive or abrading tool assembly comprising an abrasive or abrading tool having a housing, an air inlet port, and an exhaust outlet with a support for a wrist and forearm attached to the tool. In one embodiment including a pneumatically powered tool, the support extends toward and over the air inlet port and dust bag outlet. The abrading tool may be a rotary tool. The present invention also includes a wrist/forearm support for an abrading tool including a substantially flat body, two forks projecting from the body wherein each fork defines an orifice, and in which the orifices are positioned substantially opposite from each other, and possessing a support member that extends from the bottom of the body in the direction of the tool.

18 Claims, 8 Drawing Sheets

COMFORT GRIP FOR AN ORBITAL ABRASIVE HAND TOOL

FIELD OF THE INVENTION

The present invention is in the field of mechanical or powered abrasive tools, specifically in the field of handheld orbital sanders and more specifically, in the field of ergonomically designed grips for handheld orbital sanders.

BACKGROUND OF THE INVENTION

Hand-held orbital sanders and other handheld abrading or abrasive tools are common in the prior art having been available to the general public for several decades. One problem common to handheld (portable) powered sanders, including orbital sanders, is the tool grip is configured in such a way that the user is required to arch his wrist, which over a period of time will tend to cause wrist strain and eventually chronic injuries such as carpal tunnel syndrome. Typically, the user must grip the sander on top of the housing with the abrasive material, such as a sandpaper sheet, attached to the rotating bottom of the sander. In order to provide sufficient pressure to the abrasive tool, the user must press down on the top of the housing while at the same time arching the wrist out of the way of the attached air hose, for pneumatic sanders, power cord, and/or dust and air exhaust. This problem may be exacerbated by the addition of a dust collection bag attached to the exhaust. In several embodiments, the hand must simultaneously hold down a "dead-man" type power switch. These strained gripping positions can lead to long-term, if not permanent damage to the hand, wrist, and/or distal portion of the forearm. Although there exist innumerable embodiments of handheld sanders, they fail to disclose a sander with an ergonomically comfortable gripping surface for handheld sanders, including rotary sanders.

U.S. Pat. No. D494,434 to Sun, et al. is typical in that it discloses a handheld pneumatic burnishing device having a relatively large switch that is held by the gripping hand as the burnishing device is operated. An air inlet and exhaust extends out from the housing under the switch. Because the '434 device lacks a hand or wrist support or rest, the user is required to arch his/her wrist and cup the hand in order to hold the switch and simultaneously maneuver the tool on the surface to be treated.

U.S. Pat. No. D458,102 to Tseng and U.S. Pat. No. D438,078 to Leu are similar in structure to the tool in the '434 patent in that they include a switch held by the gripping hand and they also lack any type of wrist or forearm resting device or a guard to prevent the wrist or forearm from contacting either the inlet or inlet hose and the exhaust duct or bag. U.S. Pat. No. D436,817, also to Leu, features a dust bag outlet that extends from underneath the switch, but provides no stable component on which to rest the gripping hand's wrist or forearm. U.S. Pat. No. D353,984 to Izumisawa discloses an orbital sander similar to that of the '817 patent in that the exhaust duct extends some distance from the housing of the sander. However, the exhaust duct, aside from possessing a curved shape unsuitable for supporting a wrist, is also positioned below the level of the switch, making it unavailable for a wrist or forearm rest even if the shape of the duct was more suitable.

U.S. Patent Publication No. 2003/0228833 to Boyer is typical of handheld sanders and other similar abrasive tools designed to be held with two hands in that the switch is located under one of the handles and it can only be effectively operated using two hands. In addition, it lacks any component that can be used as a guard or rest for supporting the wrist or forearm.

Therefore, there is a need in the field for an orbital abrasive tool ergonomically designed to be held with one hand and that provides a guard or rest for the user's wrist or forearm to prevent carpel tunnel syndrome and other injuries to the gripping hand.

SUMMARY OF THE INVENTION

The present invention broadly comprises an abrasive or abrading tool assembly comprising an abrading tool having a housing, an air inlet port, an exhaust outlet, and a support for a wrist and forearm, in which the support is fixedly attached to the abrading tool and extends toward the air inlet port and dust bag outlet. In one embodiment, the abrading tool is a rotary tool. In an alternate embodiment, the air inlet port may be replaced by an electric power cord in electrically powered tools.

The present invention also includes a wrist/forearm support for an abrading tool comprising a substantially flat body, two longitudinal members projecting from the body wherein each longitudinal member defines an orifice, in which the orifices are positioned substantially opposite from each other, and a support member that extends from the bottom of the body in the direction of the tool. In a preferred embodiment, the wrist/forearm support also includes a bridge between the ends of the two longitudinal members with the bridge, forks and body of the support defining an orifice.

One object of the invention is to provide a support for the wrist and/or forearm of the hand used to grasp or grip a handheld abrading or abrasive tool.

A second object of the invention is to enable a user to effectively grip a handheld abrasive tool without arching the wrist.

A third object of the invention is to allow a user to grip an abrasive tool with the palm of the hand resting on the tool.

An additional object of the invention is to decrease injuries caused by prolonged gripping of a handheld abrasive tool.

A further object of the invention is to reduce occurrences of carpel tunnel syndrome and other chronic injuries caused by the improper or awkward grips of users holding abrasive tools.

A further object of the invention is to provide protection for a user's hand from hot exhaust air and sharp edges and corners from the air inlet port, the exhaust duct and dust bag, and the dust bag coupling attaching the dust bag to the exhaust duct.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF THE INVENTION

At the outset, it should be appreciated that like drawing numbers on different drawing views identify identical structural elements of the invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Figure 1:
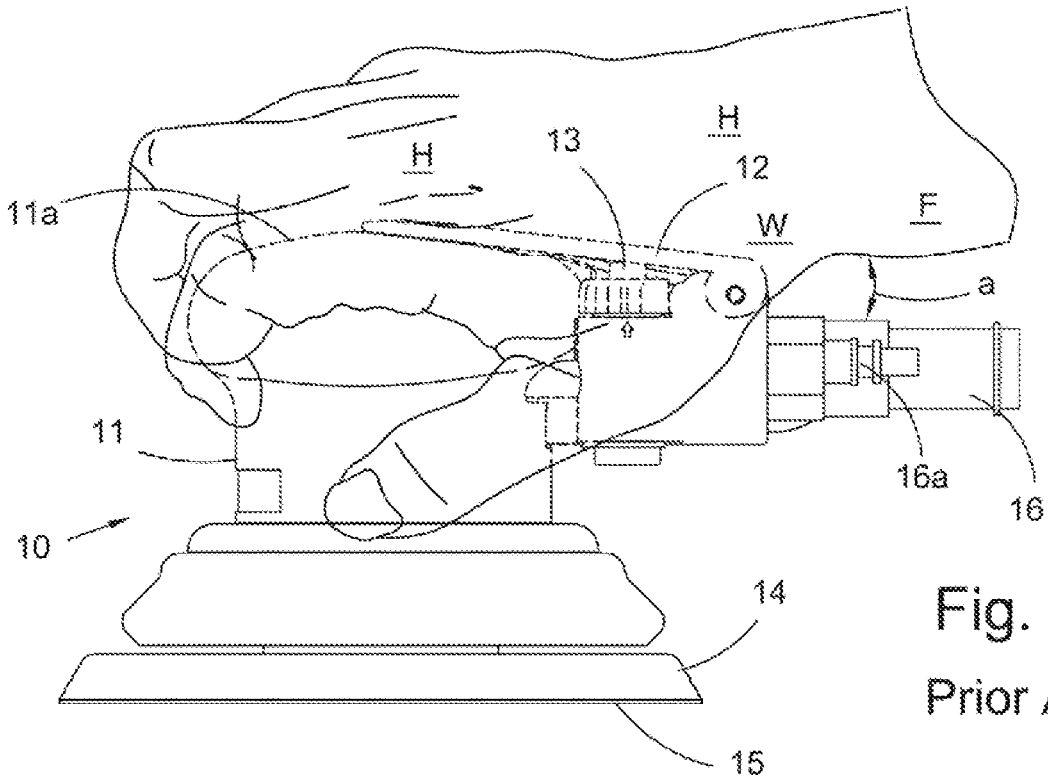
Fig. 1 Prior Art
FIG. 1 is a side view of a prior art rotary abrasive tool designed being gripped by one hand.

Adverting to the drawings, FIG. 1 is a side view of a prior art rotary abrasive tool 10 ("tool 10") designed to be held by one hand gripped being by one hand. Housing 11 includes top surface 11*a* (in faded outline) which is gripped by hand H. Hand H holds down valve actuator 12 to press down piston 13 to apply power to tool 10. Air intake 16a and exhaust 16 are seen extending from housing 11 under hand H. Pad 14 holds abrasive material 15 to be applied to the article to be treated. One example of abrasive material 15 may be sandpaper. Prominent in this view is angle a formed between the wrist portion W and air intake 16*a* depicting the lack of support for wrist W and forearm F which can lead to injuries and chronic debilitating conditions such as carpel tunnel syndrome.

Figure 2:
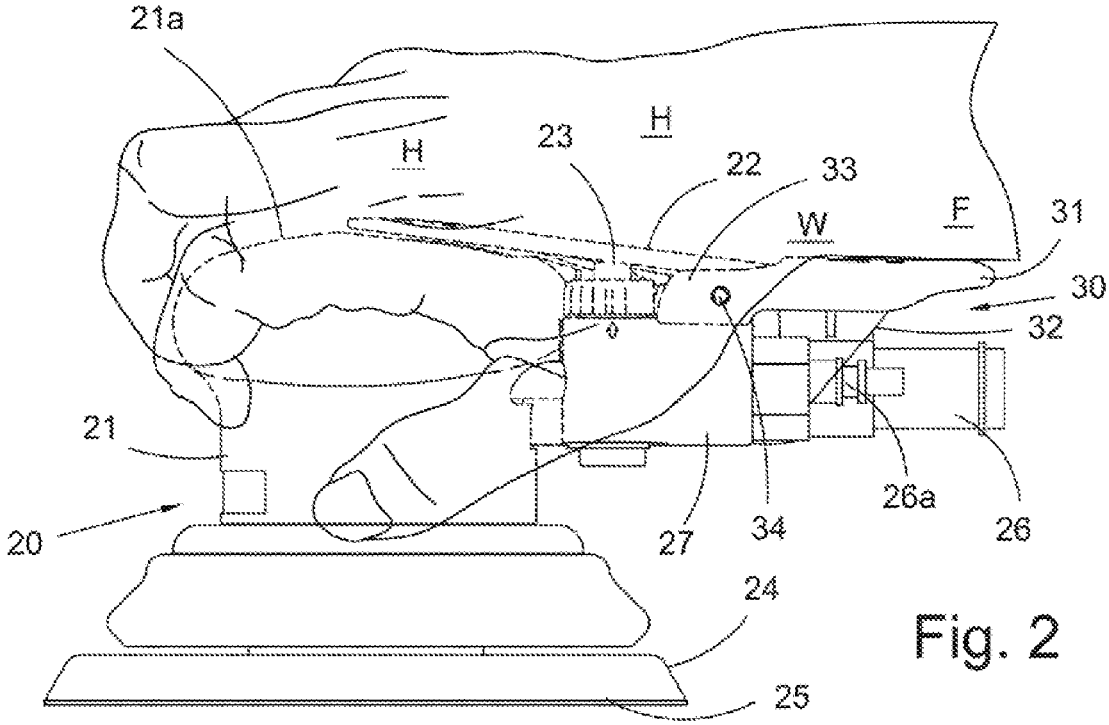
FIG. 2 is a side view of the abrasive tool of the present invention being gripped by one hand.

FIG. 2 is a side view of abrasive tool 20 ("tool 20") of the present invention being gripped by a user's hand. In the embodiment shown, tool 20 is a rotary abrasive tool. However, persons of skill in the art will recognize that the present invention may be adapted to be used with similar hand tools. Tool 20 includes a power source connection such as a compressed air connection or an electrical power source connection. Housing 21 includes top surface 21*a* (in faded outline) which is overlain by hand H. Hand H presses down valve actuator switch 22 ("switch 22") forcing down piston 23 to apply power to tool 20. Switches similar in structure and attachment to tool 20 may be used for electrically powered tools 20 although switches for both pneumatically and electrically powered tools may be placed in other positions on tool 20. Duct system 27 extends from housing 21. In the embodiment shown in which tool 20 is pneumatically powered, duct system 27 terminates in both exhaust duct 26 and air intake 26*a*. Alternatively, duct system 27 may be configured as two separate ducts that extend from housing 21 and terminate separately in air intake port 26*a* and exhaust duct 26. In either case, if required, a dust collector bag (not shown) may be attached to exhaust duct 26. In an alternate embodiment, air intake port 26*a* may be replaced on tool 20 by an electric power cord and also preferably may include an exhaust duct.

Wrist-forearm support 30 ("support 30") is attached to the top of duct 27 and extends out toward and preferably over duct 27 and exhaust duct 26 and air intake 26*a*. In FIG. 2, wrist W and forearm F are seen resting on body 31 of support 30. Although body 31 can take any suitable shape, in a preferred embodiment, body 31 is substantially flat to comfortably support wrist W and/or forearm F. Support member 32 extends from the bottom surface of body 31 to duct 27 to provide support for body 31 when it holds wrist W and/or forearm F. In an alternate embodiment, support member 32 may contact housing 21. In another alternate embodiment, support member 32 may comprise two or more support members 32 extending to either housing 21 or duct 27.

Longitudinal members 33 extend from body 31. Each of longitudinal members 33 defines a pin orifice 34 with each of pin orifices 34 directly opposite the other pin orifice 34. As will be discussed below, orifices 34 are positioned to receive a pin designed to pivotally hold switch 22. By pivotally hold is meant that switch 22 is held in place by support 20 in such a manner as to enable switch 22 to pivot or rotate both toward and away from surface 21*a*. Pad 24 holds abrasive material 25 to be applied to the article to be treated.

Figure 3:
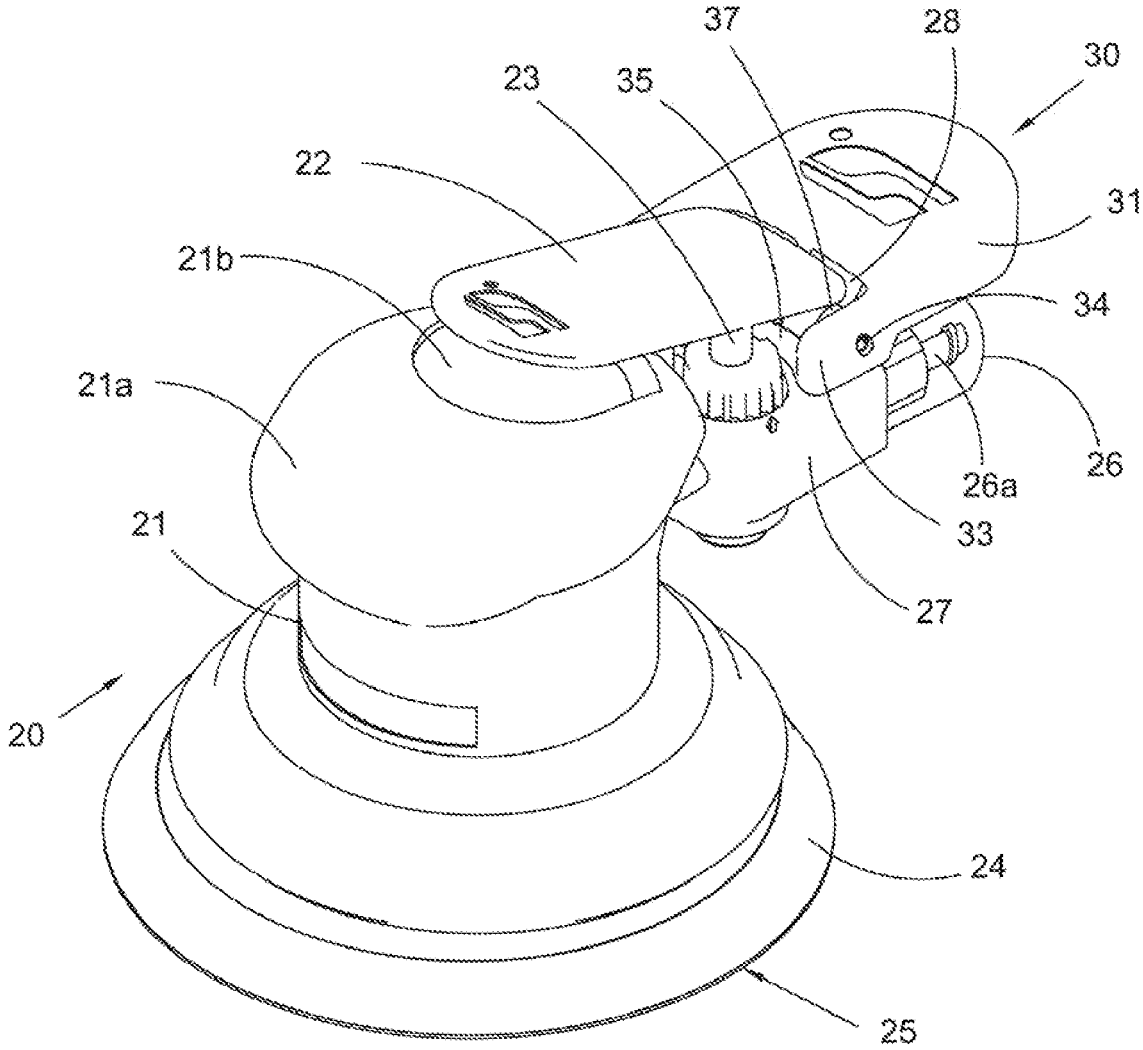
FIG. 3 is a top perspective view of the abrasive tool of the present invention.

FIG. 3 is a top perspective view of the assembly of tool 20 and support 30. Seen within top surface 21*a* is recess 21*b* which receives switch 22 when it is depressed toward top surface 21*a* to provide power to tool 20. Also seen is a partial view of bridge 35 which extends transversely between the ends of the two forks 33. Longitudinal members 33, body 31 and bridge 35 together define orifice 37 which receives switch 22. In the embodiment shown, switch 22 includes one or more receivers 28 which are placed in alignment with pin orifices 34 to enable a pin to extend through receiver(s) 28 to both of pin orifices 24 thereby holding switch 22 in pivotal attachment to duct 27. Persons of skill in the art will recognize that other methods may be used to hold switch 22 on duct 27. For example, duct 27 may be configured to include structures equivalent to receivers 28 to retain a connecting pin. In an alternate embodiment, switch 22 may be attached directly to housing 21.

Figure 4:
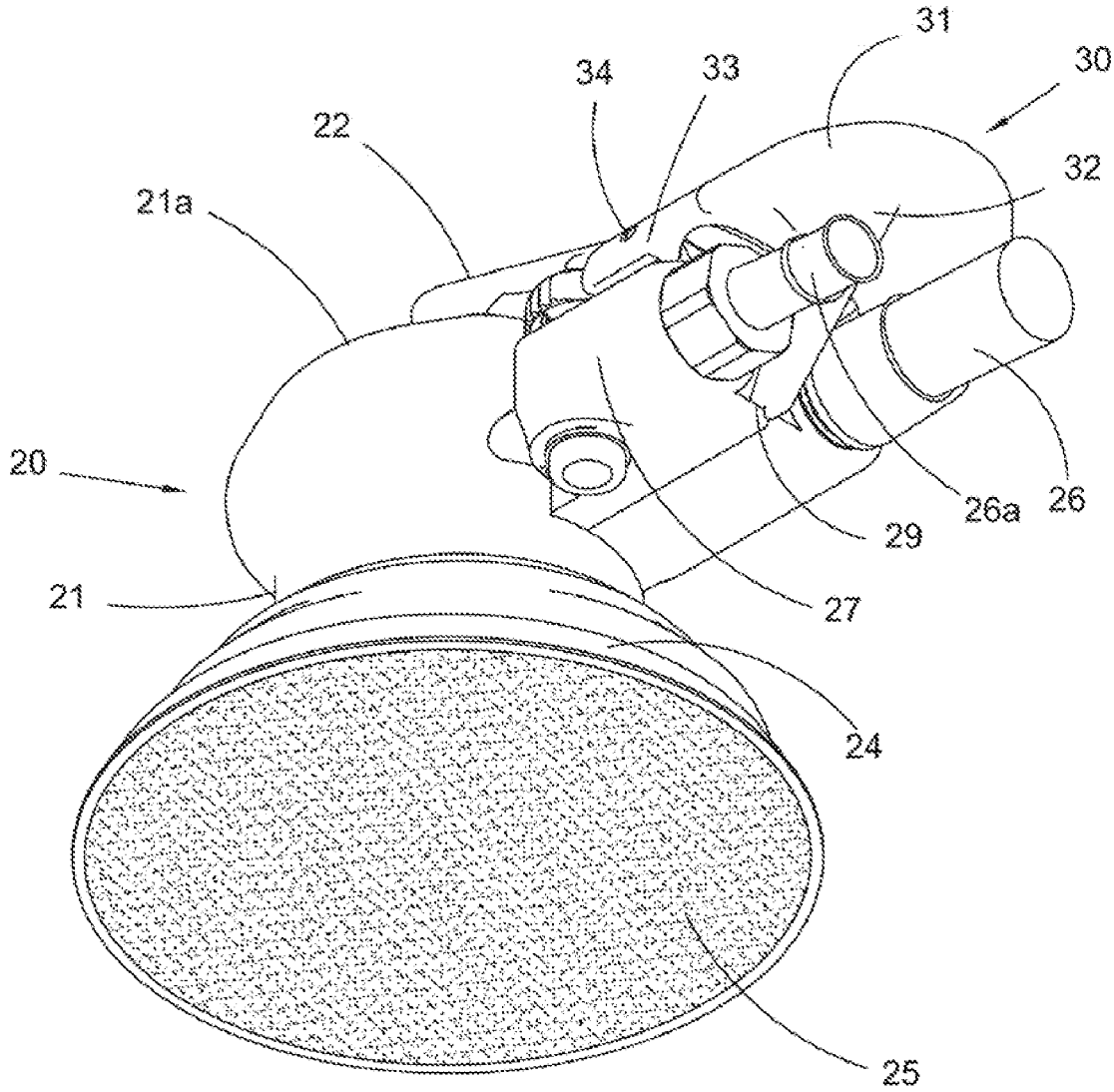
FIG. 4 is a bottom perspective view showing how the wrist-forearm support is supported by the exhaust —intake duct.
Figure 4A:
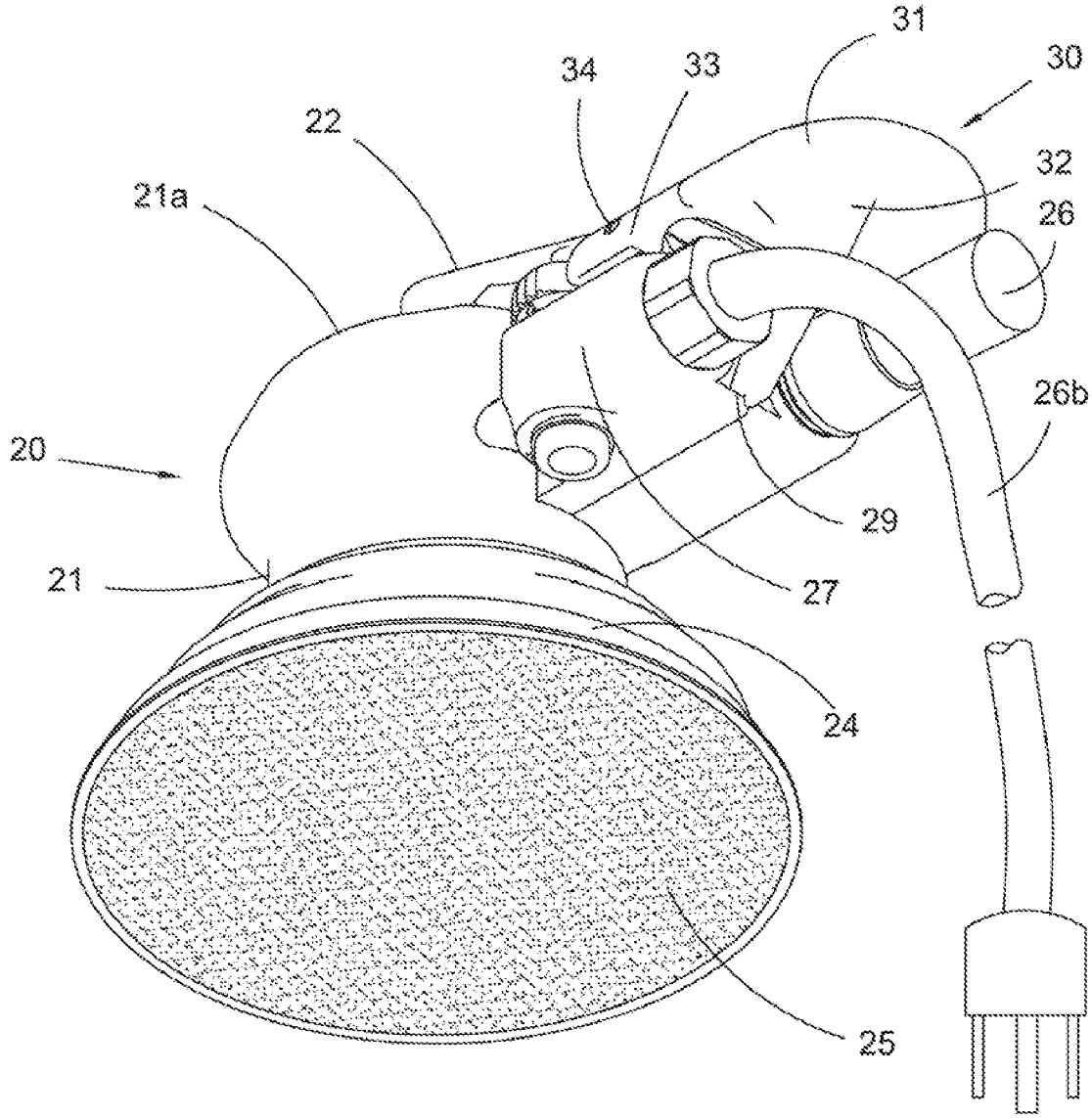
FIG. 4A is a bottom perspective view similar to that of FIG. 4 showing an electrical power connection replacing the compressed air power connection.
Figure 4B:
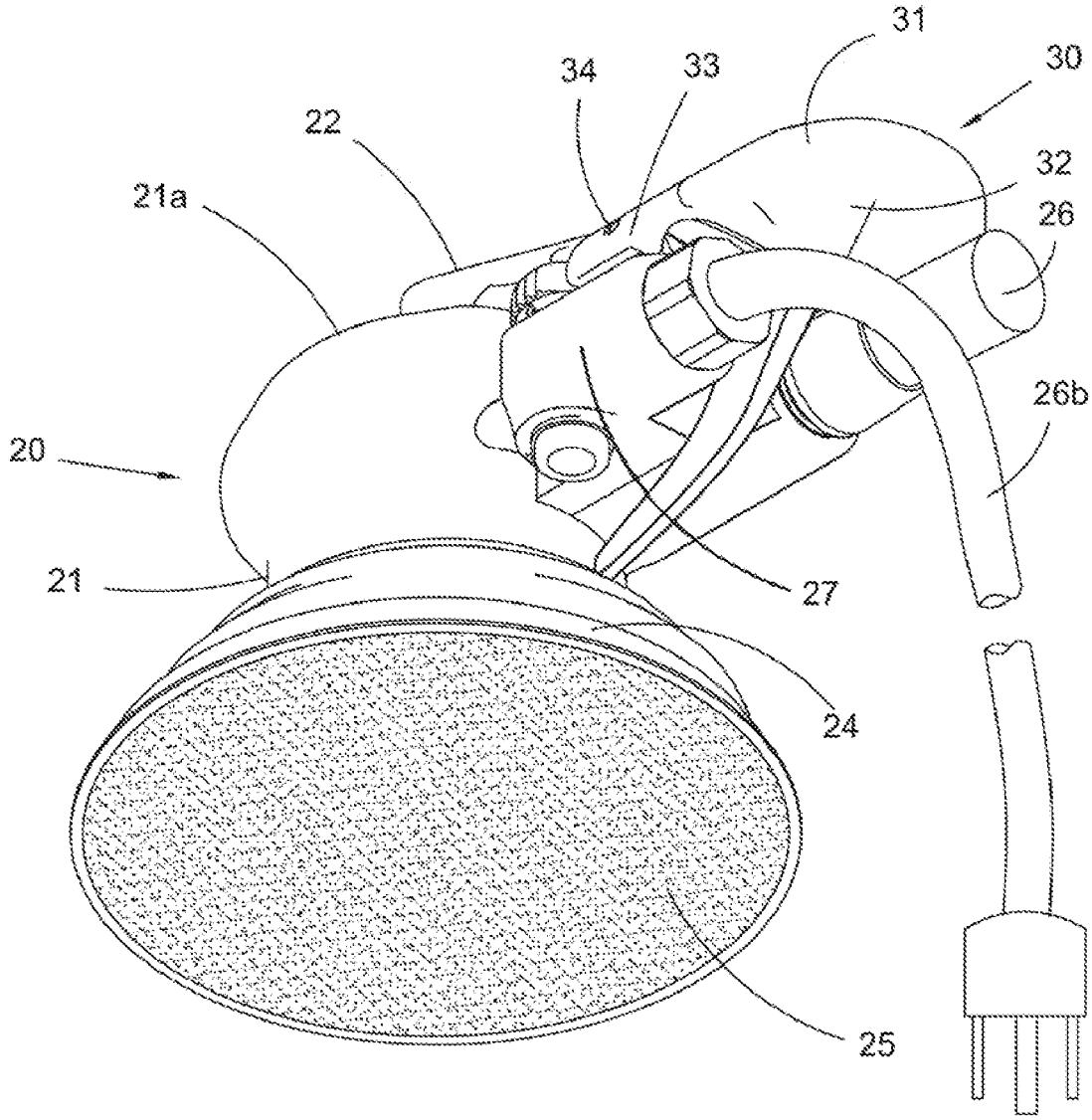
FIG. 4B is a bottom perspective view showing the support member extending to the housing of the abrading tool.

FIG. 4 is a bottom perspective view of tool 20 portraying how support 30 is supported by duct 27. Support member 32 extends from the bottom of body 31 toward tool 20 terminating on bridge 29 of duct 27 to provide underpinning to support 30 when a user's wrist and/or forearm is resting on it. Also seen is pad 24 and abrasive material 25. FIG. 4B depicts support member 32 terminating on housing 11 of tool 20.

Figure 5:
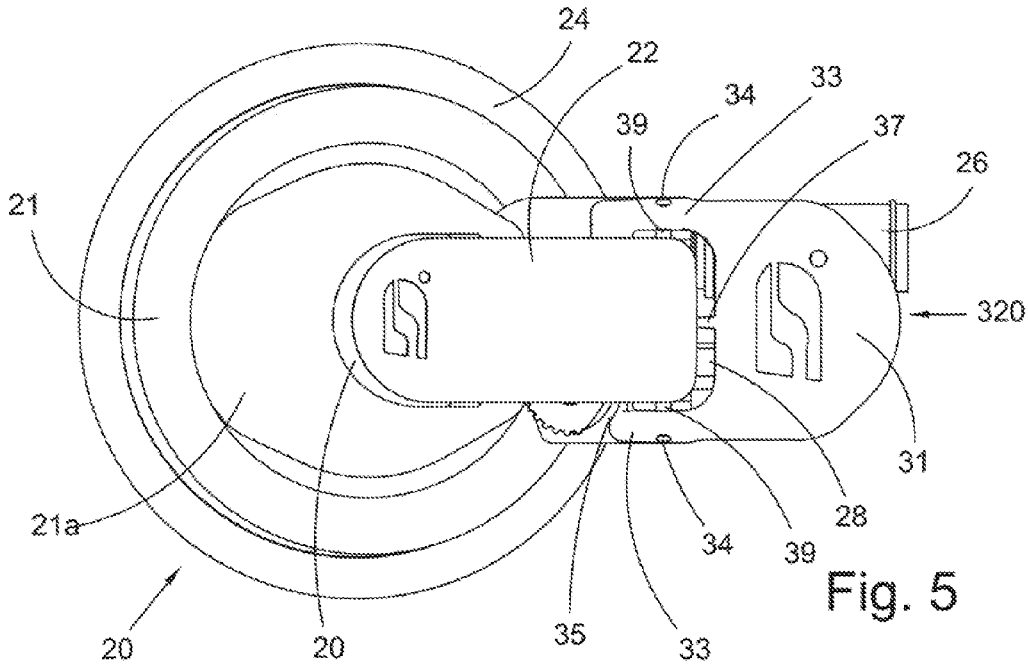
FIG. 5 is a top view of the abrasive tool of the present invention.
Figure 6:
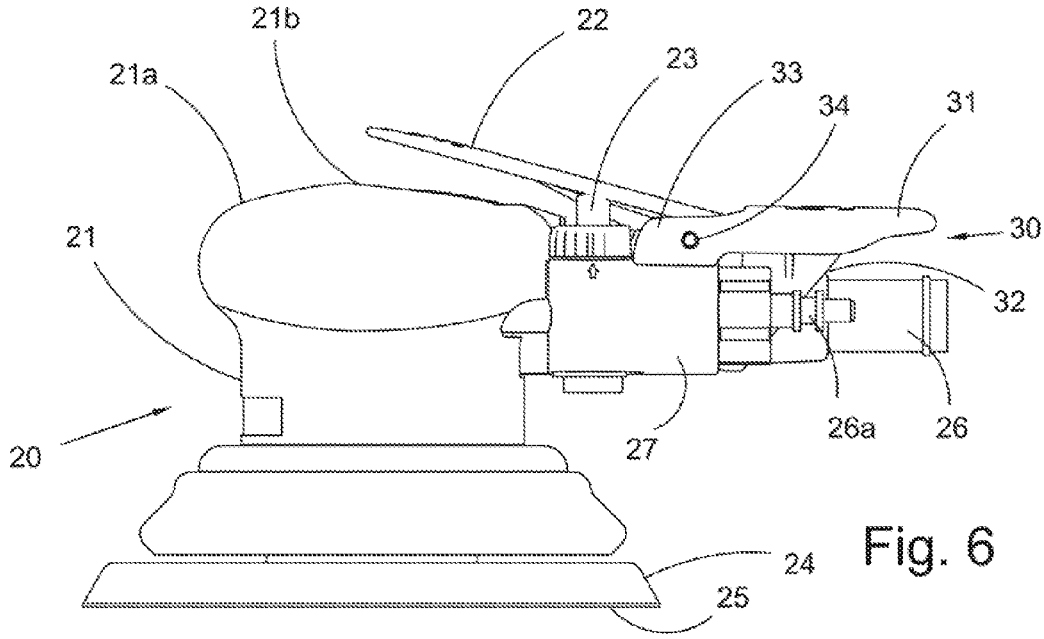
FIG. 6 is a side view of the abrasive tool of the present invention showing the switch rotated away from the top surface.

FIG. 5 is a top view of tool 20. More clearly seen in this view is receiver 28 within receiving orifice 37. Switch 22 may be molded to include receiver(s) 28 to form a component in which receiver(s) 28 are integral with switch 22. Also seen is pin 39 extending between pin orifices 34 on each of longitudinal members 33. FIG. 6 is a side view of tool 20 showing switch 22 rotated away from top surface recess 21*b*.

Figure 7:
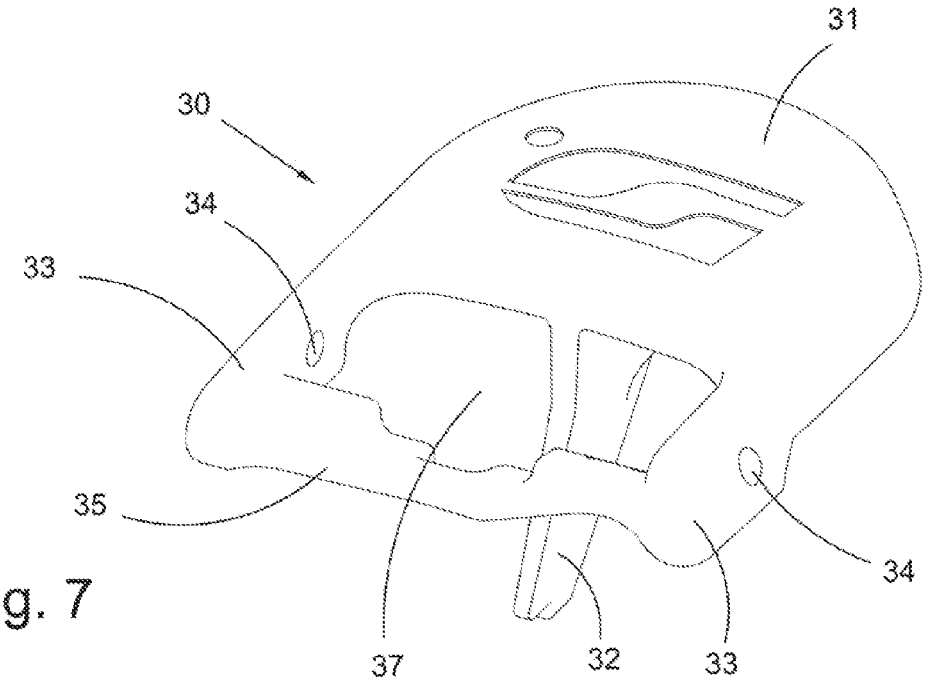
FIG. 7 is a top perspective view of the wrist-forearm support of the present invention.
Figure 8:
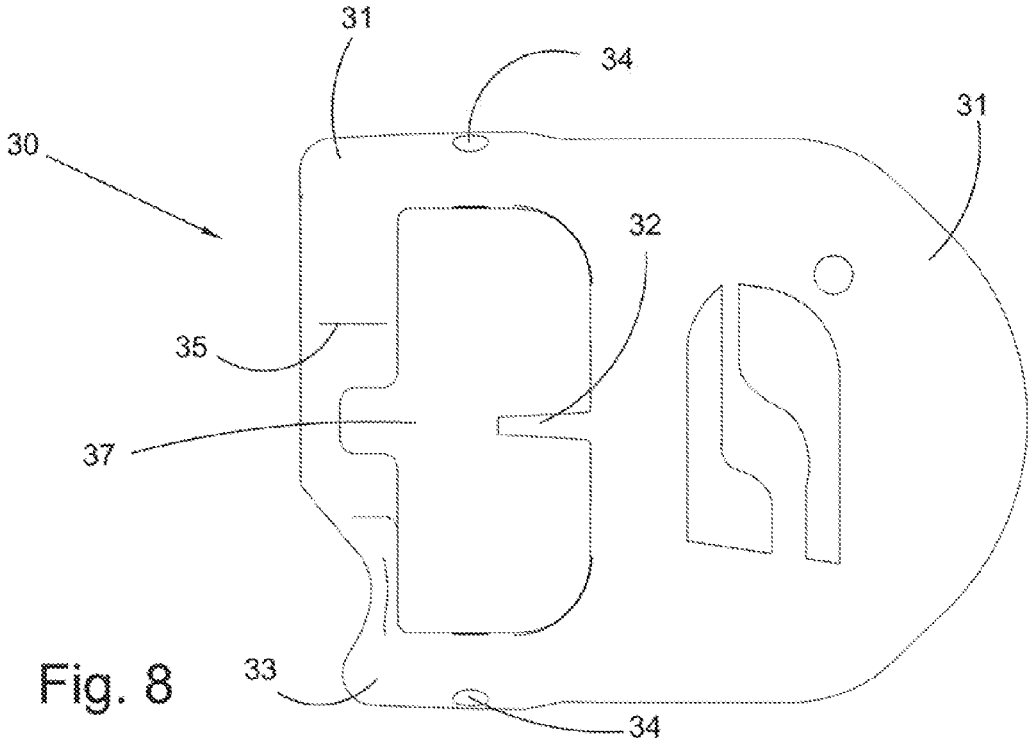
FIG. 8 is a top view of the wrist-forearm support.

FIG. 7 is a top perspective view of support 30 detached from tool 20. Clearly seen is bridge 35 extending between longitudinal members 33. Also seen are pin orifices 34 opposite each other and receiving orifice 37 defined by longitudinal members 33, bridge 35, and the edge of body 31. Also seen is support member 32 extending from the bottom of body 31. FIG. 7 depicts support 30 as an integral article meaning it is formed into one solid structure. Such a structure can be injection molded or otherwise formed using methods well known to those skilled in the art. An integral structure removes weaknesses in joints or gaps created if various structures of support 30 are joined together as separate pieces. Preferably, support 30 is fabricated from an elastomer material, such as ALCRYN®. FIG. 8 is a top view of support 30.

Figure 9:
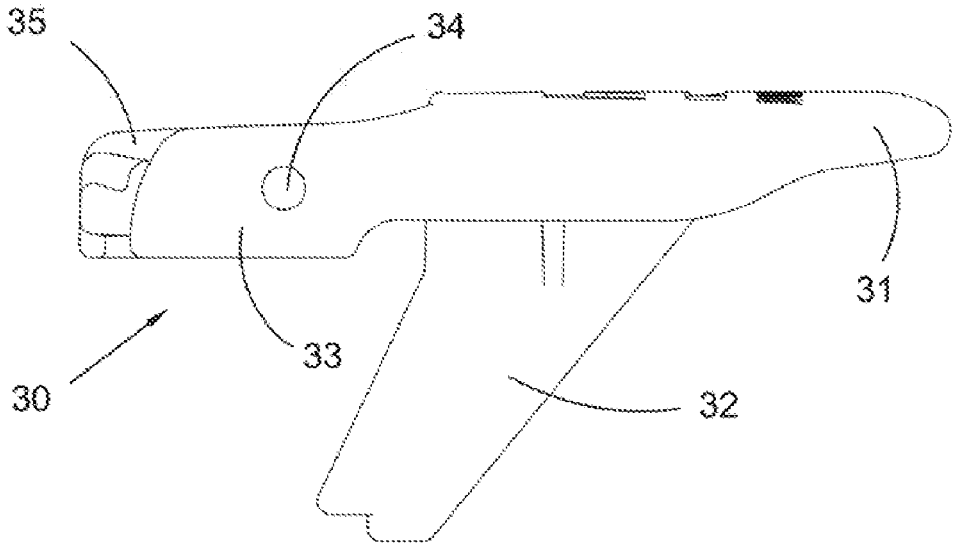
FIG. 9 is side view of support showing the underpinning support member as possessing a slanted shape; and, FIG. 10 is a rear view of the support showing beveled or rounded edges on the body of the support.

FIG. 9 is side view of support 30 clearly showing support member 32 as possessing a slanted shape. As described above, this shape enables support member 32 to extend to duct 27, housing 21, or another structure on tool 20 to provide under pinning to body 31, while enabling body 31 to extend beyond exhaust 26 and/or air intake 26*a* on duct 27. In alternate embodiments, the slanted structure of support member 32 enables body 31 to extend over a dust collector bag (not shown) attached to duct 27 of tool 20 allowing more of the length of forearm F to rest on support 30. Persons of skill in the art will recognize that a curve or arched configuration to support member 32 will similarly enable the extension of body 31 and that more than one support member 32 may be present. In another embodiment, support 30 may be about 70 mm in length.

Figure 10:
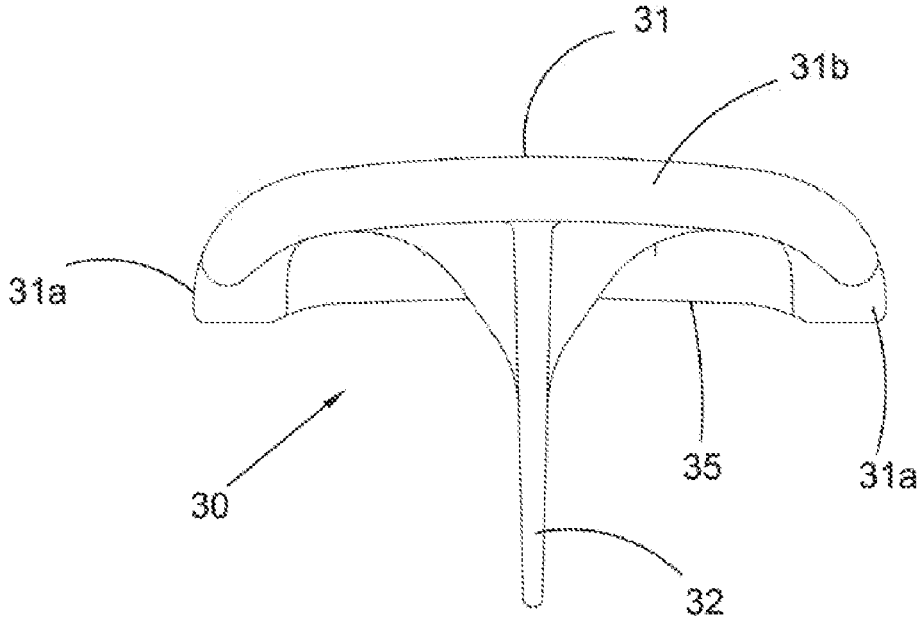

FIG. 10 is a rear view of support 30 showing a preferred embodiment in which body 31 possesses beveled or rounded lateral edges 31*a* and beveled or rounded rear edge 31*b*. The rounded shape to edges 31*a* and 31*b* reduces any discomfort caused by sharper corners on the body 31 of support 30.

Thus it is seen that the objects of the invention are efficiently obtained, although changes and modifications to the invention should be readily apparent to those having ordinary skill in the art, which changes would not depart from the spirit and scope of the invention as claimed.

We claim:

1. An abrading tool assembly comprising:

an abrading tool having at least a housing;

a duct system comprising a power source connection; and, a support for a wrist and forearm having a first end and a second end, wherein the support is fixedly attached to the abrading tool and extends toward said power source such that each of said first end and said second end are positioned over said duct system; and, wherein the support further comprises an integral support member that extends from the bottom of the support and terminates on one of the housing or duct system.

2. The abrading tool assembly as recited in claim 1 wherein said duct system comprises an exhaust duct and an air inlet port wherein said air inlet port is said power source connection.

3. The assembly as recited in claim 2 wherein the abrading tool further comprises a valve actuator pivotally attached to the abrading tool.

4. The assembly as recited in claim 2 wherein said integral support member terminates on the duct system.

5. The assembly as recited in claim 2 wherein said support extends over said duct system.

6. The assembly as recited in claim 2 wherein said support extends over said air inlet port.

7. The assembly as recited in claim 1 wherein the abrading tool is a rotary abrading tool.

8. The assembly as recited in claim 1 wherein said support extends over said duct system.

9. The assembly as recited in claim 1 wherein said support is about 70 mm in length.

10. The assembly as recited in claim 1 wherein the support has an integral construction.

11. The assembly as recited in claim 10 wherein the support is comprised of a thermoplastic elastomer.

12. The assembly as recited in claim 11 wherein the support is comprised of Alcryn.

13. The assembly as recited in claim 1 wherein said duct system comprises an exhaust duct and a electrical power cord wherein said electrical power cord is said power source connection.

14. A wrist/forearm support for an abrading tool comprising:

a substantially flat body;

two longitudinal members projecting from the body in a direction parallel to said substantially flat body wherein each longitudinal member defines an orifice, and wherein the orifices are positioned substantially opposite from each other;

a support member that extends at a nonperpendicular angle directly from the bottom of the body; and, a bridge that extends between an end of each of the two longitudinal members;

wherein said support member is integral to the bottom of said body.

15. The wrist/forearm support as recited in claim 14 wherein the wrist/forearm support is comprised of a thermoplastic elastomer.

16. The wrist/forearm support as recited in claim 15 wherein the wrist/forearm support is comprised of Alcryn.

17. The wrist/forearm support as recited in claim 14 having a length of approximately 70 mm.

18. The wrist/forearm support as recited in claim 14 wherein said support includes edges and one or more of said edges are rounded or beveled.

* * * * *